US006779474B2

(12) United States Patent
Nakagawa et al.

(10) Patent No.: US 6,779,474 B2
(45) Date of Patent: Aug. 24, 2004

(54) PERSONAL WATERCRAFT

(75) Inventors: Kenichi Nakagawa, Kobe (JP); Yoshiyuki Kuroyanagi, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/338,033

(22) Filed: Jan. 6, 2003

(65) Prior Publication Data

US 2003/0127033 A1 Jul. 10, 2003

(30) Foreign Application Priority Data

Jan. 7, 2002 (JP) ..... 2002-000650

(51) Int. Cl.[7] ..... B63B 35/73
(52) U.S. Cl. ..... 114/55.57
(58) Field of Search ..... 114/55.56, 55.5, 114/55.51, 55.52, 55.53, 55.54, 55.55, 55.57, 55.58

(56) References Cited

U.S. PATENT DOCUMENTS 3,826,220 A * 7/1974 Jacobson ..... 114/55.56
5,390,621 A * 2/1995 Hattori et al. ..... 114/55.51
5,537,948 A * 7/1996 Kobayashi ..... 114/55.57

* cited by examiner

*Primary Examiner*—Jesus D. Sotelo
(74) *Attorney, Agent, or Firm*—Kolisch Hartwell, P.C.

(57) ABSTRACT

A personal watercraft in which a battery is easily placed and charging and maintenance of the battery are easily performed, comprising: a body constituted by a deck and a hull; an engine room formed inside the body, for containing an engine; and a battery-accommodating portion for containing the battery for the engine, wherein the battery-accommodating portion is provided in the deck outside the engine room.

7 Claims, 9 Drawing Sheets

PERSONAL WATERCRAFT

BACKGROUND OF THE INVENTION

1. Field of the Invention

The present invention relates to a personal watercraft having a battery for supplying power.

2. Description of the Related Art

In recent years, so-called personal watercraft have been widely used in leisure, sport, rescue activities, and the like. There are straddle-type personal watercraft and stand-up type personal watercraft.

The straddle-type personal watercraft is provided with a straddle-type seat extending substantially from a center portion to a rear portion over a deck and straddled by a rider. Straddling the seat, the rider grips a steering handle located forward of the seat and steers the watercraft. In a portion inside a body of the watercraft located just below the seat, an engine room that contains an engine is provided. In general, the straddle-type personal watercraft has a seat for one to three riders. Hereinafter, "forward" refers to the direction toward which the watercraft moves and "rearward" refers to the opposite side.

As shown in FIGS. 8 and 9, a stand-up type personal watercraft 51 is provided with a standing deck 53 at a rear portion of a deck 52. The standing deck 53 is a space in which the rider stands and a concave portion having a flat bottom portion. FIG. 8 is a partially cutaway side view of the watercraft 51, and FIG. 9 is a plan view thereof. In FIG. 9, for the sake of convenience, an engine hood 63 is perspectively drawn without a steering member (handle pole) 56. The handle pole 56 is mounted by means of a hinge 55 in the vicinity of a front end of the deck 52 so as to be vertically pivotable around the hinge 55. A steering handle 54 is attached to a rear end of the handle pole 56. The rider stands on the standing deck 53 and grips the steering handle 54 located in front. An engine room 58 which contains an engine 57 is defined in a space inside a body which is located forward of the standing deck 53. In general, one rider rides on the stand-up type personal watercraft. The stand-up type personal watercraft 51 is propelled by a water jet pump 59.

The above-mentioned personal watercraft is equipped with a battery for starting the engine, displaying meter readings, or the like. As can be seen from the stand-up type personal watercraft 51 shown in FIGS. 8 and 9, in the conventional personal watercraft, a battery 60 is contained in the engine room 58.

However, the engine room of the personal watercraft is limited in space, and the battery 60 is placed so as not to interfere with the engine 57, an exhaust pipe 61, a propeller shaft 62, and the like. This makes it difficult for the battery 60 to be placed freely. For charging or maintenance of the battery 60, either the engine hood 63 is opened and the battery 60 is lifted through an opening 64 (see FIG. 9) above the engine room 58, or otherwise, an operator puts his/her upper body into the engine room 58 through the opening 64. The similar problem remains unsolved in the straddle-type personal watercraft.

SUMMARY OF THE INVENTION

The present invention addresses the above-described conditions, and an object of the present invention is to provide a personal watercraft in which a battery is easily placed and charging and maintenance of the battery are easily performed.

According to the present invention, there is provided a personal watercraft comprising: a body constituted by a deck and a hull; an engine room formed inside the body, for containing an engine; and a battery accommodating portion for accommodating a battery for the engine, wherein the battery accommodating portion is provided in the deck outside the engine room.

With such a configuration, since the battery is not required to be installed in the limited space of the engine room, the battery is easily placed and charging and maintenance of the battery are easily performed. In addition, this frees space within the engine room to install and maintain other devices.

The personal watercraft may further comprise a straddle-type seat provided over the deck and above the engine room to be straddled by a rider, steps respectively provided on both sides of the straddle-type seat on the deck for the rider to put feet thereon, and deck fins respectively provided externally adjacent the steps that are raised from the steps, and the battery accommodating portion may be provided inside of at least one of the deck fins.

The above-mentioned personal watercraft is a so-called straddle-type personal watercraft. In the straddle-type personal watercraft, sidewall portions formed by deck members are provided outside the respective steps. Since the battery-accommodating portion is provided by using an extra space inside the sidewall portion, the battery can be efficiently accommodated without changing the external design appearance of the conventional personal watercraft. Maintenance or the like of the battery accommodated in the sidewall portion becomes easy as described above.

Preferably, the battery-accommodating portion may be provided at a position adjacent a rear end of the straddle-type seat on the deck. In this case, since the battery is accommodated in the vicinity of the rear end of the straddle-type seat, maintenance or the like is easily performed. Also, since the seat is typically placed along the longitudinal center axis of the body, the battery is correspondingly placed substantially on the longitudinal center axis. As a result, weight of the battery in right and left direction of the body is properly in balance.

In the personal watercraft, the engine room may be placed in a front portion inside the body, the watercraft may further comprise: a standing deck provided in the deck rearward of the engine room for the rider to stand thereon, and the battery-accommodating portion having an openable cover is provided on a front end portion of the standing deck.

The above-mentioned personal watercraft is a so-called stand-up type personal watercraft. The battery is easily installed on the standing deck. As a matter of course, maintenance or the like of the battery installed on the deck is easy. Also, in this case, the battery is provided substantially on the longitudinal center axis of the body.

Preferably, the cover of the battery-accommodating portion may be openably provided to be pivotable around a hinge provided in a deck portion which is the rear end of the engine room and located in front of the standing deck.

Since the cover for the battery-accommodating portion is pivotably attached onto the deck independently of the engine hood rather than integrally with the engine hood, opening/closing of the cover becomes easy.

Preferably, the deck has raised portions continuously raised from a right side, a left sides and a front side of the standing deck, and the battery-accommodating portion may be defined on the front portion of the standing deck by the openable cover and the raised portions. With such a configuration, since the raised portions are used as a part of the battery-accommodating portion, the cover is simply configured and the external design appearance of the conventional body need not be greatly changed.

Preferably, the personal watercraft may further comprise an engine hood to cover an opening formed on an upper portion of the engine room disposed in a front portion of the body, and the cover of the battery-accommodating portion may be provided continuously with a rear end of the engine hood.

In this configuration, the engine hood is extended rearward from the rear end of the engine hood, and the extended portion is used as the cover for the battery-accommodating portion. This configuration reduces the number of parts.

Preferably, the battery may be placed at a center portion of the body in a width direction thereof.

The above and further objects and features of the invention will be more fully apparent from the following detailed description with accompanying drawings.

DETAILED DESCRIPTION OF THE PREFERRED EMBODIMENT

Hereinafter, an embodiment of a personal watercraft (hereinafter simply referred to as a watercraft) according to an embodiment of the present invention will be described with reference to the accompanying drawings.

Figure 1:
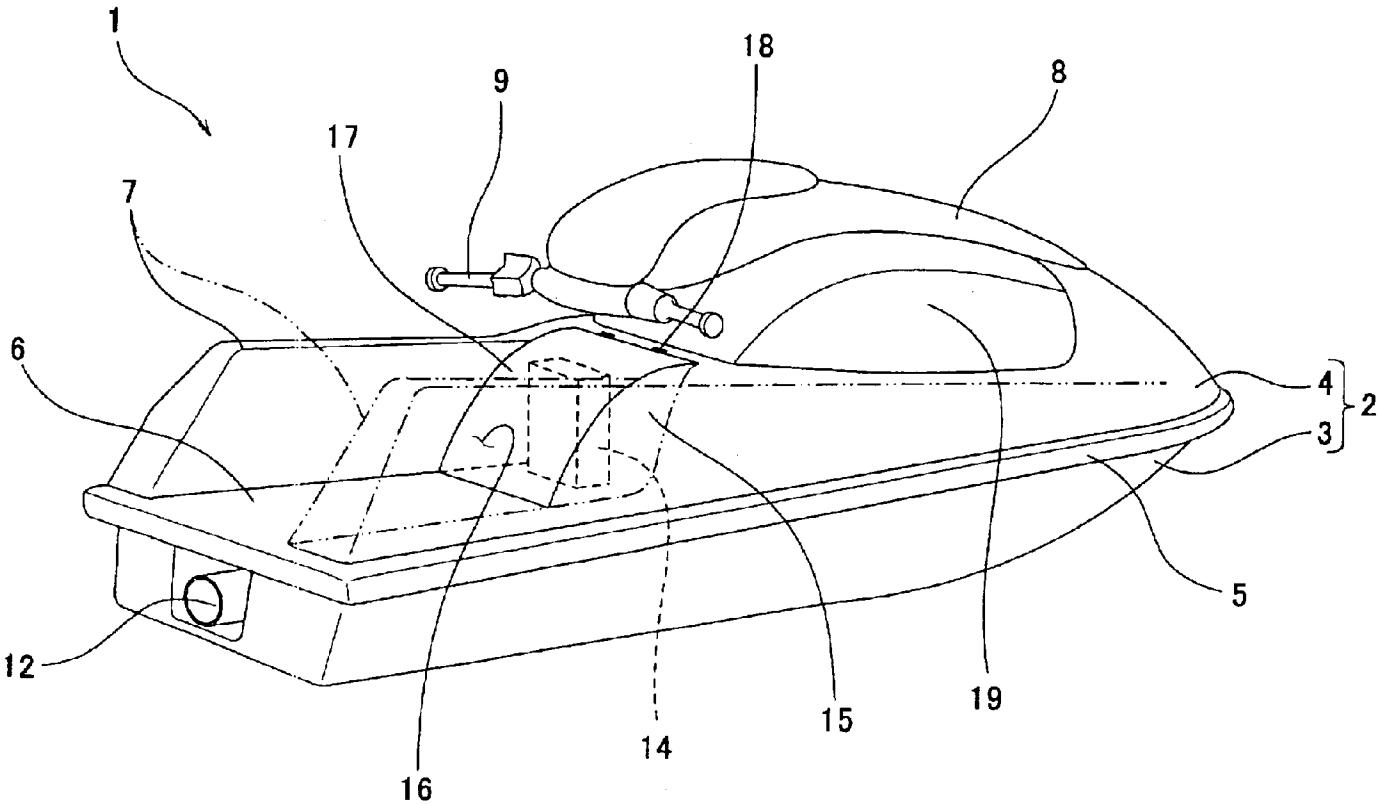
FIG. 1 is a partially perspective view showing a personal watercraft according to an embodiment of the present invention.

Referring to FIG. 1, a personal watercraft 1 is a stand-up type personal watercraft propelled by a water jet pump. A body 2 of the watercraft 1 comprises a hull 3 and a deck 4 covering the hull 3 from above. A line at which the hull 3 and the deck 4 are connected over the entire perimeter thereof is called a gunnel line 5. Reference numeral 12 denotes a pump nozzle through which water is ejected rearward by the water jet pump.

A standing deck 6 having a flat floor on which a rider stands is provided on the deck rearward of an engine room 10. The standing deck 6 is configured to be lower than an upper surface of the engine room 10. Convex wall portions (deck fins) 7 as side wall portions are provided on right and left sides of the standing deck 6. Each of the deck fins 7 has proper width to define an inner space. A handle pole 8 is mounted onto the deck 4 forward of the standing deck 6 so as to be vertically pivotable around its front portion as a support point. A bar-type steering handle 9 is attached to a rear end of the handle pole 8. Standing on the standing deck 6, the rider grips the steering handle 9 and steers the watercraft 1 while raising the handle pole 8.

As indicated by a dotted line in FIG. 2, an engine 11 is disposed in the space (engine room) 10 in the body 2 surrounded by the hull 3 and the deck 4 below the handle pole 8. A propeller shaft 13 is connected to an output shaft of the engine 11 and extends rearward inside the body 2. Such a structure is identical to that of the conventional watercraft.

Figure 2:
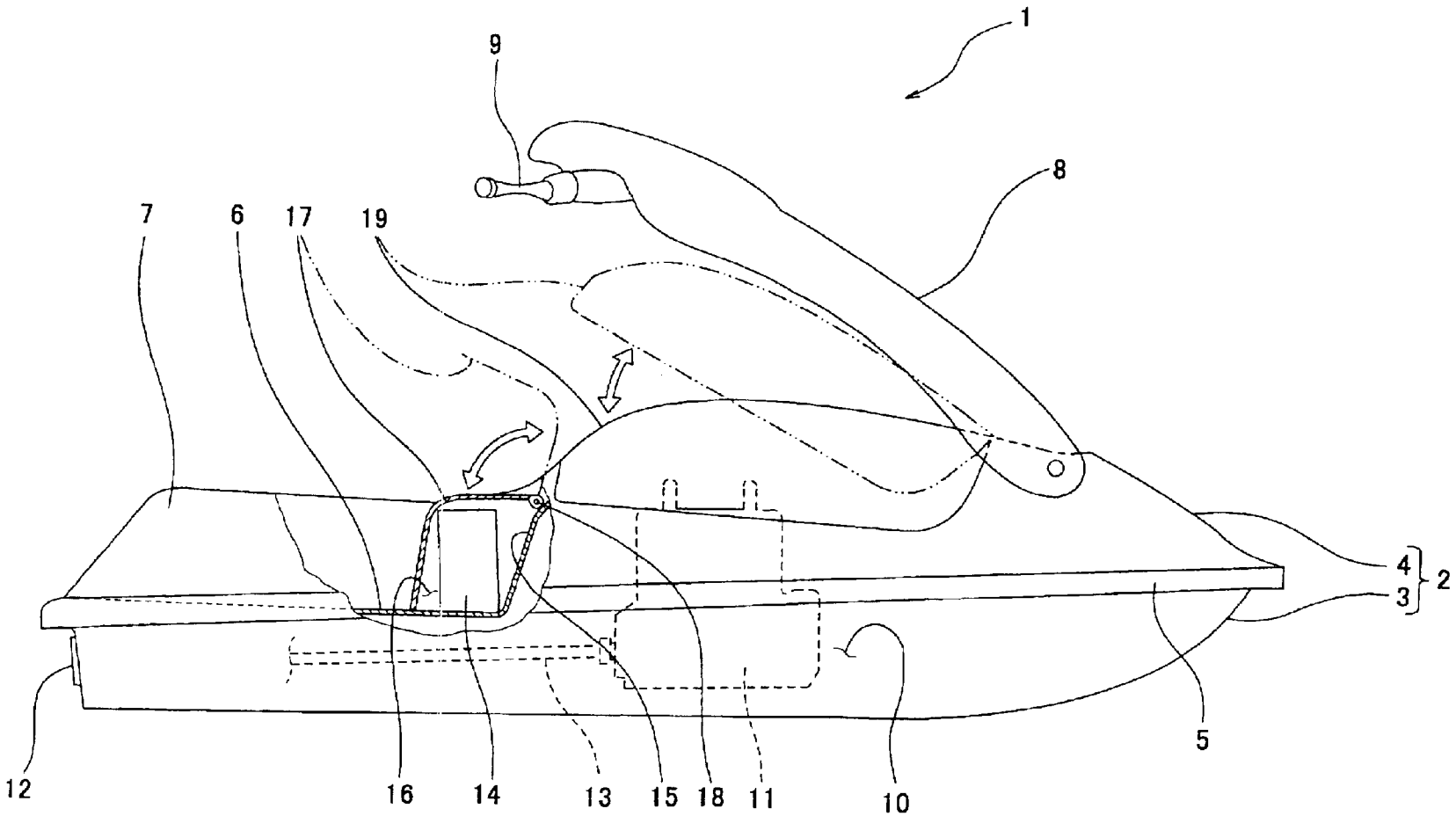
FIG. 2 is a partially cutaway side view of the personal watercraft in FIG. 1.

The personal watercraft 1 differs from the conventional personal watercraft in that a battery 14 for supplying required power (e.g., for starting the engine) is placed on the standing deck 6 in the vicinity of its front end as shown in FIG. 2. The battery is easily installed on a flat bottom surface of the standing deck 6. The standing deck 6 is surrounded by deck portions (raised portions) raised from the right and left sides and the front side of the standing deck 6. Specifically, the raised portion is raised from the front side of the standing deck 6 to define a rear end of the engine room 10 and deck fins 7 are vertically provided so as to be raised from the right and left sides of the standing deck 6. The raised portion at the rear end of the engine room 10 is called a front wall portion 15. A battery cover 17 is provided to cover the battery 14 installed on the front portion of the standing deck 6 from above and behind. The battery cover 17, the right and left deck fins 7, and the front wall portion 15 define a battery accommodating portion 16. A front edge of the battery cover 17 is attached onto the front wall portion 15 by means of a hinge 18. The battery cover 17 is opened/closed by vertically pivoting around the hinge 18. Irrespective of the installation of the battery-accommodating portion 16, the standing deck 6 located behind the battery-accommodating portion 16 has a sufficient space required for the rider.

With such a configuration since the battery 14 is placed on the standing deck 6, charging and maintenance of the battery become easy. Besides, the battery 14 is easily located at the center portion of the body 2 in the width direction. By placing the battery 14 and the battery cover 17 such that their centers of gravity are positioned substantially on the longitudinal center axis of the body 2, weight of the battery 14 and weight of the battery cover 17 in the right and left direction of the body 2 are properly in balance. This allows greater freedom in placement of other devices in the engine room or the like.

As a matter of course, the right and left deck fins 7 are not necessarily used to define the battery-accommodating portion 16. For example, the battery cover 17 may be shaped to cover the battery 14 from the right and left sides, and from above and behind. In other words, a gap is created between each of both side portions of the battery cover 17 and each of the deck fins 7. Also, preferably, a seal member (not shown) is attached to the periphery of the battery cover 17 which is in contact with the surface of the deck 4 so as to function as a water seal between the deck surface and the battery cover 17. Further, preferably, a locking device (not shown) is provided for locking the battery cover being at a closed position. Moreover, preferably, a biasing means such as a spring member is mounted for improving the water seal function by pressing the periphery of the battery cover being at the closed position against the deck surface.

Figure 3:
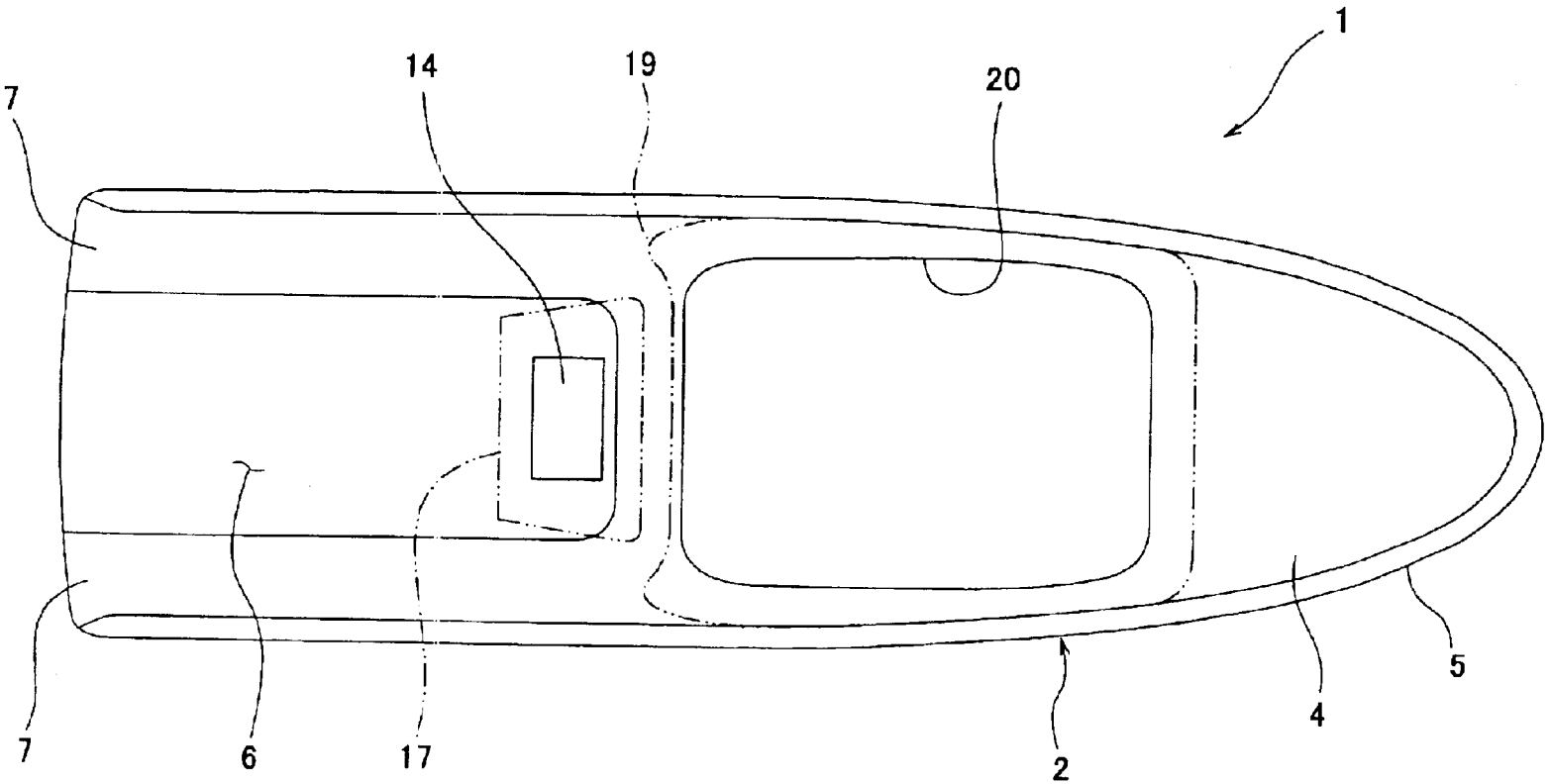
FIG. 3 is a plan view of the personal watercraft in FIG. 1, perspectively showing an engine hood without a handle pole.

In FIG. 2, reference numeral 19 denotes an engine hood. As shown in FIG. 3, the engine hood 19 serves to open/close an opening (hatch) 20 formed in the deck 4 portion on the upper side of the engine room 10. A front end of the engine hood 19 is attached onto an upper surface of the deck 4 by means of a hinge (not shown). The engine hood 19 is pivotable around the hinge. The engine hood 19 pivots upwardly to open the hatch 20, and maintenance or the like of the engine 11 or other devices is carried out through the hatch 20.

Figure 4:
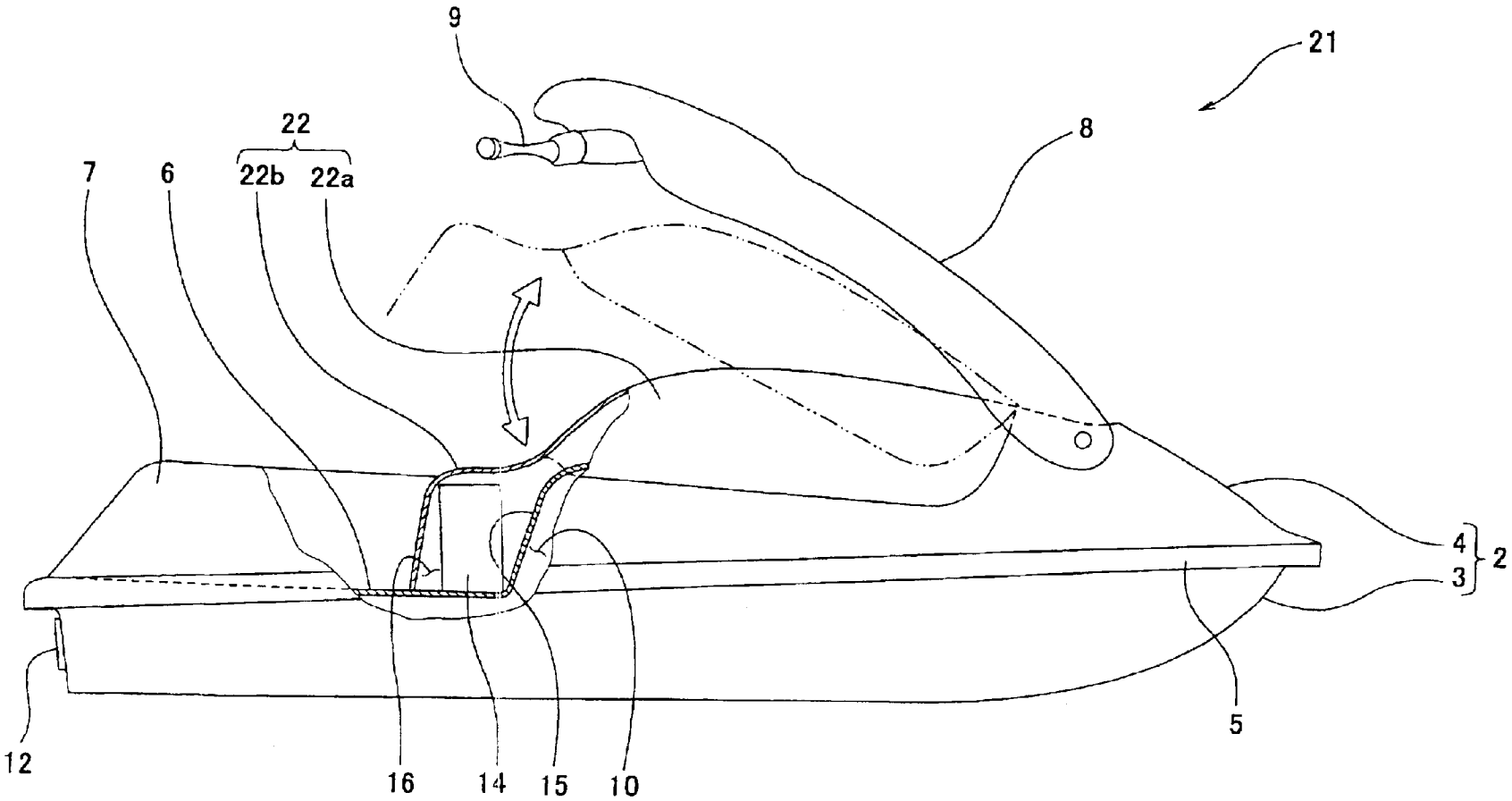
FIG. 4 is a partially cutaway side view showing another embodiment of the personal watercraft according to the present invention.
Figure 5:
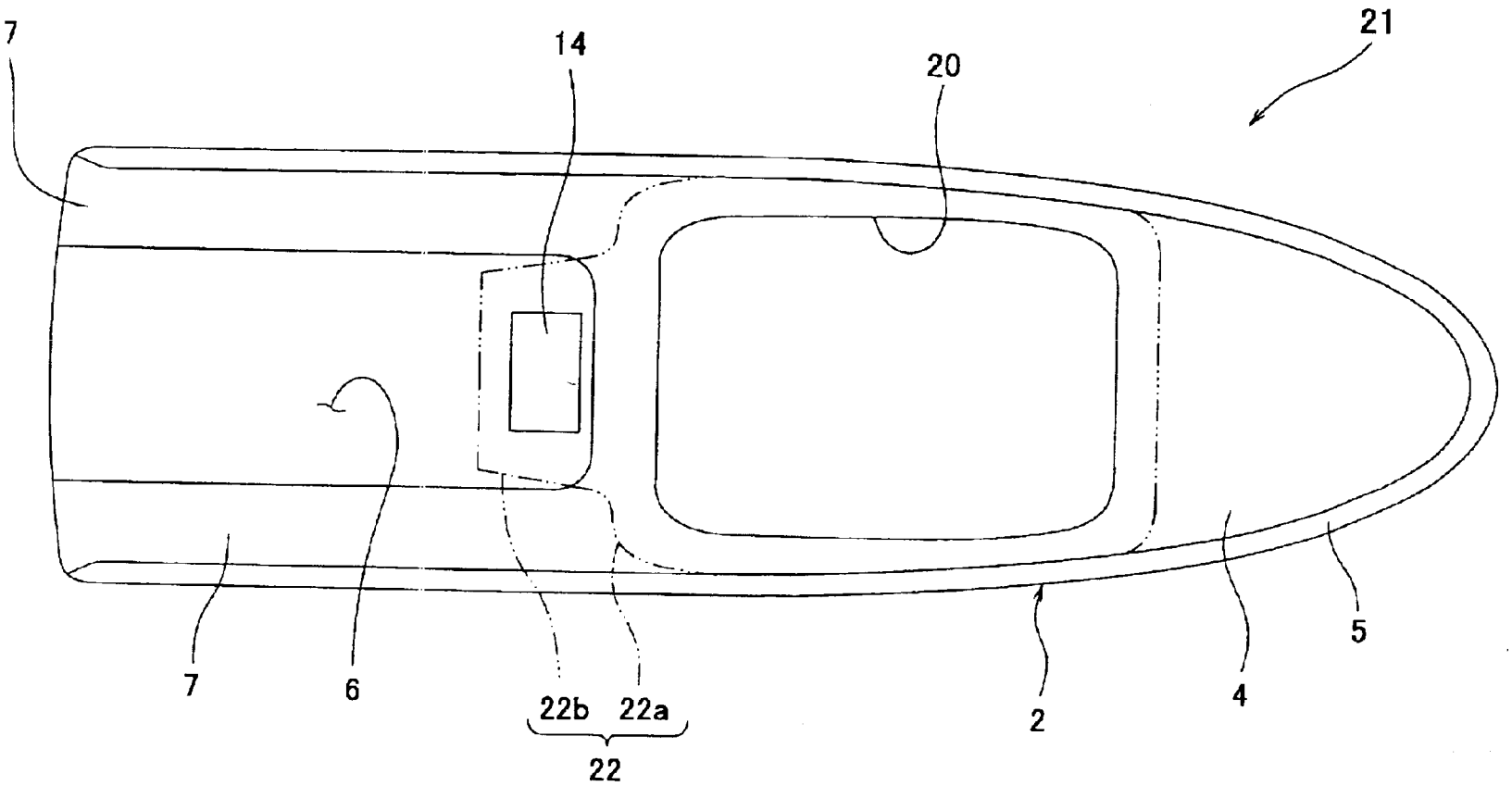
FIG. 5 is a plan view of the personal watercraft in FIG. 4.

A stand-up type personal watercraft 21 shown in FIGS. 4 and 5 has an integrated cover 22 comprised of an engine hood portion 22*a* and a battery cover portion 22*b* of the battery accommodating portion 16. FIG. 4 is a partially cutaway side view of the watercraft 21. FIG. 5 is a plan view of the watercraft 21, perspectively showing the integrated cover 22 without the handle pole 8, for the sake of convenience. A front end of the engine hood portion 22*a* is attached onto the upper surface of the deck 4 by means of a hinge (not shown) so that the integrated cover 22 is pivotable around the hinge, and from the rear end of the engine hood portion 22*a*, the battery cover portion 22*b* is extended. Like the battery cover 17 in FIGS. 1, 2, and 3, the battery cover portion 22*b* may cover the battery 14 from above and behind, and the right and left deck fins 7 and the front wall portion 15 surround the battery 14, thus defining the battery-accommodating portion 16. Alternatively, the battery cover portion 22*b* may be shaped to cover the battery 14 from the right and left sides and from above and behind. Further, alternatively, it is preferable that the above-identified seal member may be attached to the periphery of the integrated cover 22, the above-identified locking device may be provided, and the above-identified biasing means may be mounted.

In the above-described embodiment, the stand-up type personal watercraft has been described, but the present invention is not intended to be limited to the stand-up type personal watercraft. For example, even in the straddle-type personal watercraft, the battery may be installed outside the engine room.

Figure 6:
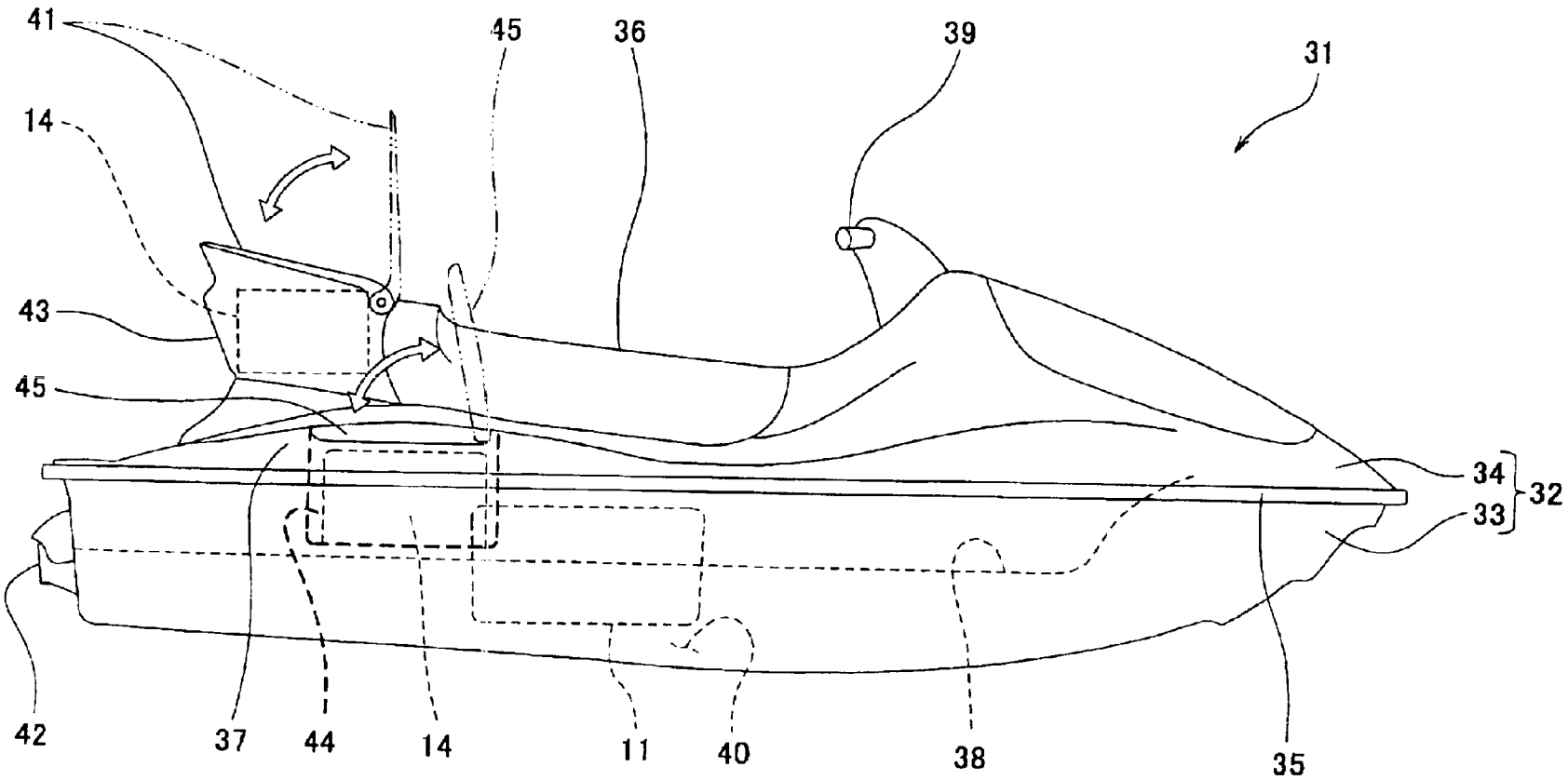
FIG. 6 is a side view showing a personal watercraft according to another embodiment of the present invention.
Figure 7:
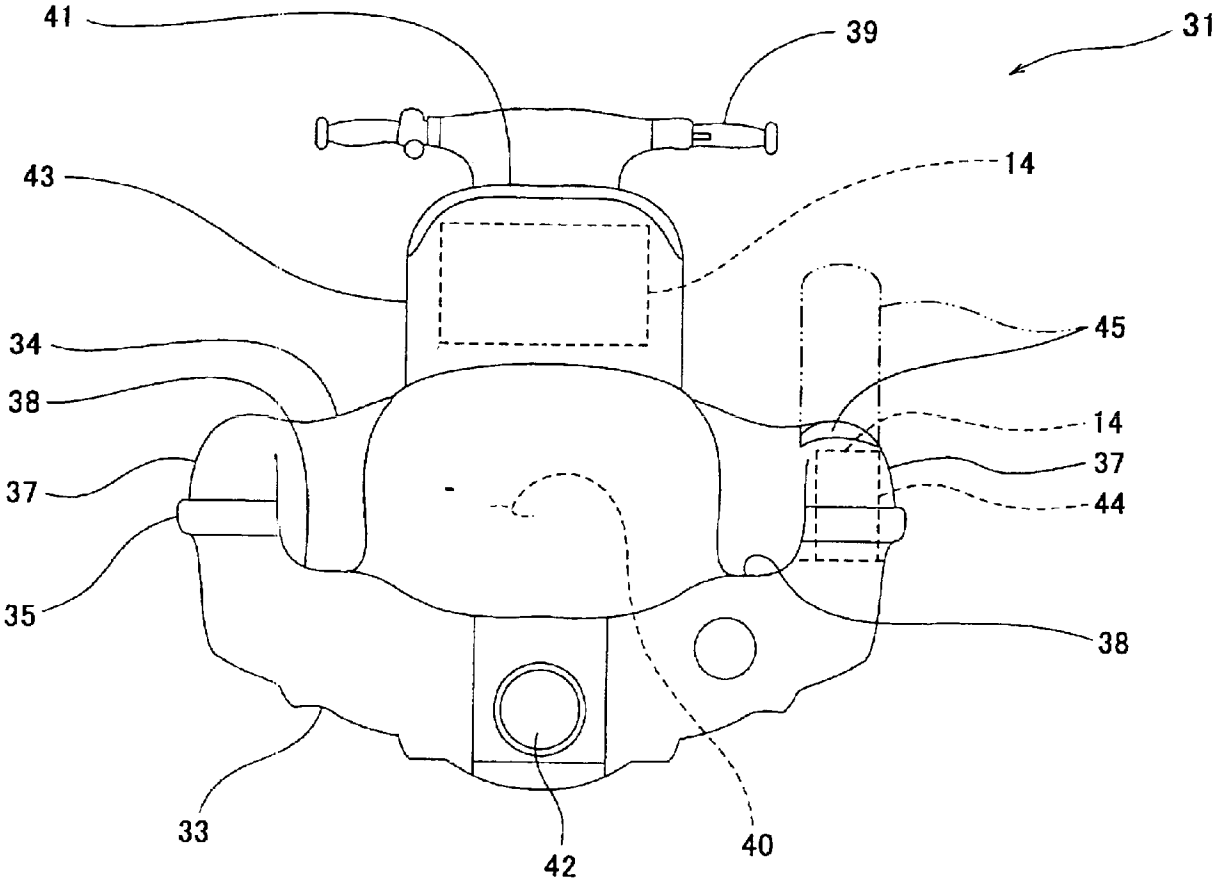
FIG. 7 is a rear view of the personal watercraft in FIG. 6.
Figure 8:
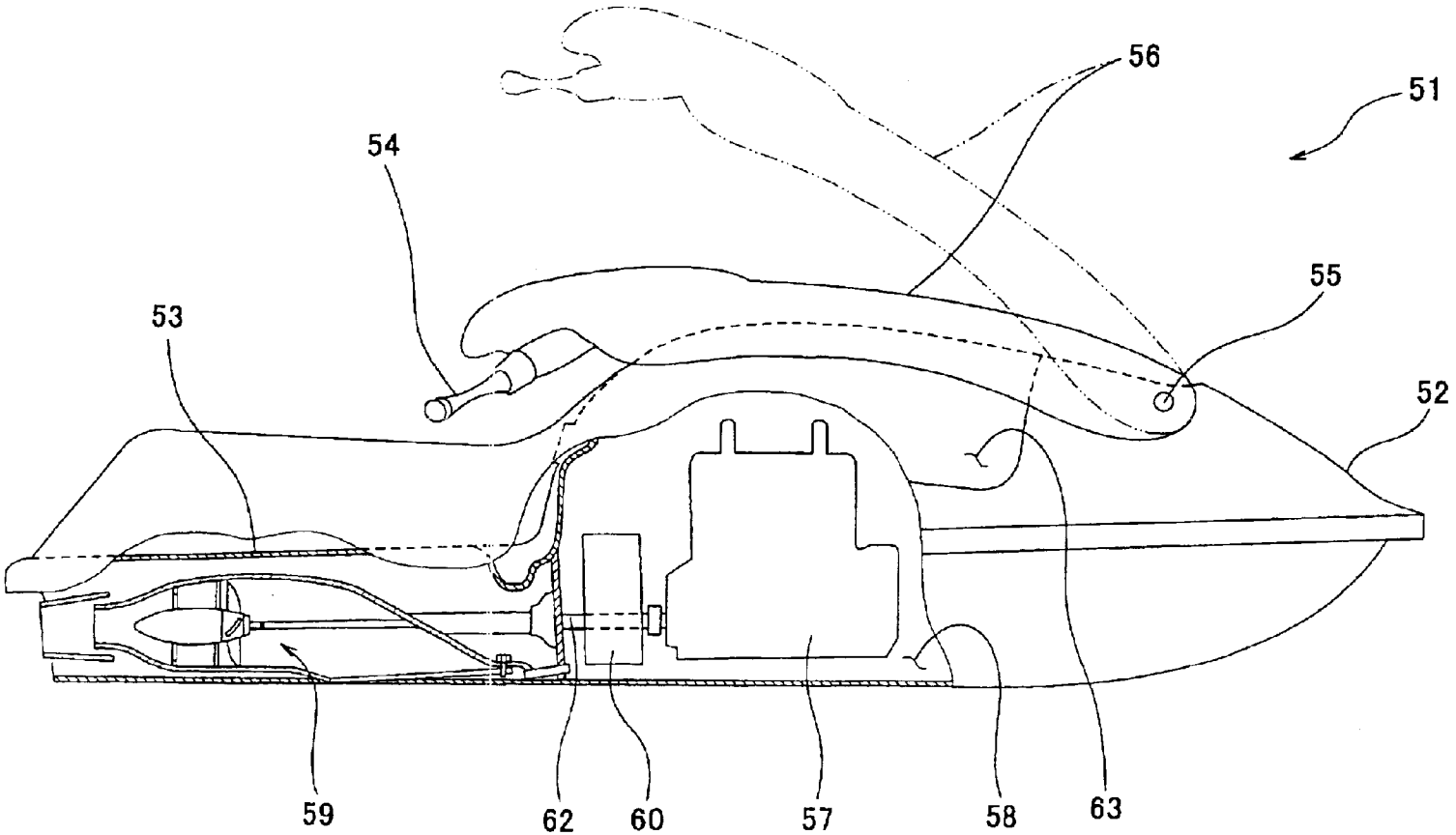
FIG. 8 is a partially cutaway side view showing an example of the conventional personal watercraft.
Figure 9:
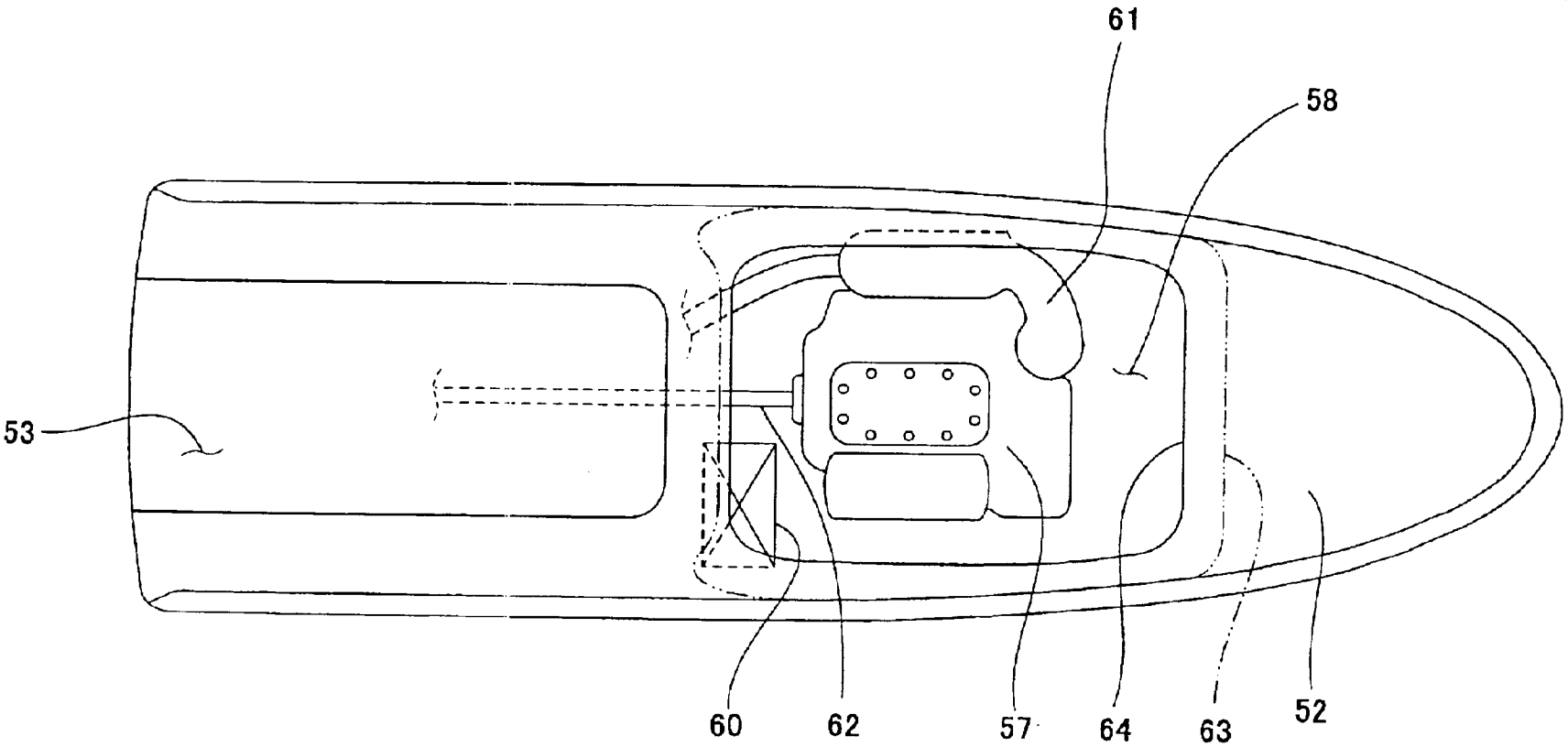
FIG. 9 is a plan view of the personal watercraft in FIG. 8.

In FIGS. 6 and 7, a straddle-type personal watercraft 31 is shown. The watercraft 31 is also propelled by the water jet pump (not shown). A body 32 of the watercraft 31 is constituted by a hull 33 and a deck 34 covering the hull 33 from above. Reference numeral 35 denotes a gunnel line. Reference numeral 42 denotes a pump nozzle.

A straddle-type seat 36 which the rider straddles extends substantially from the center portion to the rear portion over the deck 34 in the longitudinal direction. Straddling the seat 36, the rider grips a steering handle 39 located forward of the seat 36 and steers the watercraft 31. An engine room 40 is defined in the body 32 below the seat 36 to contain the engine 11. The seat 36 covers an opening (not shown) formed in the deck 34, through which an operator accesses to the engine room 40, and is adapted to open/close the opening.

Steps 38 are respectively provided externally adjacent the right and left sides of the seat 36 and the engine room 40. The steps 38 are configured to be lower than the upper surface of the seat for the rider to put feet thereon. Deck fins 37 are provided externally adjacent the steps 38 such that they are respectively raised from the steps 38 as having proper width to define inner spaces.

A box-like container 43 as the battery-accommodating portion is provided on the deck 34 at the rear end of the seat 36. The battery 14 is contained in the box-like container 43. The container 43 is shaped to be substantially continuous with the seat 36. A battery cover 41 is attached onto an upper surface of the container 43 so as to pivot upwardly to open the container 43. Thus, by providing the battery-accommodating portion 43 on the deck 34, charging and maintenance of the battery 14 are facilitated. Also, the battery 14 is easily located at the center portion of the body 32 in the width direction thereof. Further, the above structure allows greater freedom in placement of other devices in the engine room 40.

As indicated by a bold dashed line in FIGS. 6 and 7, instead of placing the box-like container 43 at the rear of the seat 36, a battery-accommodating portion 44 for accommodating the battery 14 may be provided inside of at least one of the right and left deck fins 37. An upper portion of the battery-accommodating portion 44, i.e., part of an upper surface of the deck fins 37 is opened, and a battery cover 45 may be hinged over the opening to be vertically pivotable. By positioning the battery cover 45 in this manner, the battery 14 may be placed under and close to the battery cover 45. So, this is convenient for charging and maintenance.

The stand-up type personal watercraft 1 shown in FIGS. 1 to 5 also has the deck fins 7. Therefore, the battery-accommodating portion can be provided in the deck fins 7.

As should be appreciated from the foregoing description, the battery is installed outside the engine room rather than in the engine room limited in space. Thereby, charging and maintenance of the battery become easy.

Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A personal watercraft comprising:

a body constituted by a deck and a hull;

an engine room formed inside the body, for containing an engine;

a battery-accommodating portion for accommodating a battery for the engine;

a swaddle-type seat provided over the deck and above the engine room to be straddled by a rider;

steps respectively provided on both sides of the straddle-type seat on the deck for the rider to put feet thereon, and deck fins respectively provided externally adjacent the steps as being raised from the steps, wherein the battery-accommodating portion is provided inside of at least one of the deck fins.

2. A personal watercraft comprising:

a body constituted by a deck and a hull;

an engine room formed inside the body, for containing an engine;

a battery-accommodating portion for accommodating a battery for the engine; and a straddle-type seat provided over the deck and above the engine room to be straddled by a rider, wherein the battery-accommodating portion is provided at a position adjacent to a rear end of the straddle-type seat on the deck.

3. A personal watercraft comprising:

a body constituted by a deck and a hull, so as to form a space inside thereof, the deck having a front wall portion, and right and left deck fins;

an engine room formed in a front portion of the space and configured to contain an engine, the front wall portion defining a rear end of the engine room;

a standing deck provided in the deck to be located rearward of the engine room, for a rider to stand thereon, the front wall portion being raised from a front end of the standing deck, and the right and left deck fins being raised from right and left ends of the standing deck, respectively;

a battery-accommodating portion provided in a front portion on the standing deck and defined by the front wall portion and the right and left deck fins, for accommodating a battery for the engine; and an openable cover configured to cover the battery-accommodating portion, the openable cover being configured to be moved upwardly to be opened to thereby allow the battery within the battery-accommodating portion to be exposed.

4. The personal watercraft according to claim 3, wherein an opening is formed in a portion of the deck on an upper side of the engine room to allow the engine room to be accessible therethrough, the personal watercraft further comprising:

an engine hood vertically pivotably attached on a portion of the deck that is located forward of the opening, the openable cover being formed integrally with a rear end of the engine hood.

5. The personal watercraft according to claim 3, wherein the openable cover is attached to be vertically pivotable around a hinge provided on the front wall portion.

6. The personal watercraft according to claim 3, wherein the openable cover is shaped to cover the battery-accommodating portion at least from above and from behind with the openable cover closed.

7. The personal watercraft according to claim 3, wherein the openable cover is shaped to cover the battery-accommodating portion from above, from behind, and from right and left sides, with the openable cover closed.

* * * * *